US005628632A

United States Patent [19]

Doane

[11] Patent Number: 5,628,632

[45] Date of Patent: *May 13, 1997

[54] PIVOTABLE TORSO EXERCISE SUPPORT

[76] Inventor: Michael P. Doane, 1434 Cola Dr., McLean, Va. 22101

[ * ] Notice: The term of this patent shall not extend beyond the expiration date of Pat. No. 5,540,591.

[21] Appl. No.: 397,334

[22] Filed: Mar. 2, 1995

Related U.S. Application Data

[63] Continuation-in-part of Ser. No. 326,901, Oct. 21, 1994, Pat. No. 5,540,591, which is a continuation-in-part of Ser. No. 145,544, Nov. 4, 1993, Pat. No. 5,429,564, which is a continuation-in-part of Ser. No. 998,195, Dec. 29, 1992, abandoned.

[51] Int. Cl.[6] ..... A63B 69/10

[52] U.S. Cl. ..... 434/254; 482/56; 482/68

[58] Field of Search ..... 482/55, 56, 68, 482/111, 112; 434/254

[56] References Cited

U.S. PATENT DOCUMENTS

| | | | |
|---|---|---|---|
| 2,109,775 | 5/1938 | Hudson . | |
| 3,085,356 | 4/1963 | Wayfield . | |
| 3,140,549 | 7/1964 | Wayfield . | |
| 3,544,103 | 12/1970 | Conable | 482/130 |
| 3,791,646 | 2/1974 | Marchignoni . | |
| 4,537,396 | 8/1985 | Hooper . | |
| 4,674,740 | 6/1987 | Iams et al. . | |
| 4,830,363 | 5/1989 | Kennedy . | |
| 4,844,450 | 7/1989 | Rodgers . | |
| 4,872,668 | 10/1989 | McGillis et al. . | |
| 4,979,734 | 12/1990 | Sims . | |
| 5,029,848 | 7/1991 | Sleamaker . | |
| 5,158,513 | 10/1992 | Reeves | 482/56 |
| 5,354,251 | 10/1994 | Sleamaker | 482/96 |
| 5,376,060 | 12/1994 | Murray | 482/56 |

FOREIGN PATENT DOCUMENTS

| | | | |
|---|---|---|---|
| 2038826 | 9/1992 | Canada | 273/82 |
| 485304 | 10/1929 | Germany . | |
| 3441725 | 7/1988 | Germany . | |
| 755285 | 8/1980 | U.S.S.R. . | |
| 1523-154 | 11/1989 | U.S.S.R. | 482/56 |
| 1567-228 | 5/1990 | U.S.S.R. | 482/56 |
| 1600-814 | 10/1990 | U.S.S.R. | 482/56 |
| 1646-560 | 5/1991 | U.S.S.R. | 482/56 |

OTHER PUBLICATIONS

International Search Report dated Feb. 25, 1995.

*Introduction to Fluid Mechanics,* Fox & McDonald. 1973. John Wiley & Sons, Inc. New York. pp. 336–370.

*Primary Examiner*—Gene Mancene

*Assistant Examiner*—Yvonne R. Abbott

*Attorney, Agent, or Firm*—Morgan & Finnegan

[57] ABSTRACT

An exercising apparatus is disclosed having an exercise bench with independent supports for a user's hips and torso, the hip support is horizontally positioned with respect to the exercise bench while the pivotal torso support is angled upwardly on the bench relative to the floor upon which the exercise bench is resting, and is capable of arcuate rotation along an axis that is located above the upper surface of the support.

13 Claims, 2 Drawing Sheets

PIVOTABLE TORSO EXERCISE SUPPORT

RELATED APPLICATIONS

The above-identified application is a continuation-in-part of prior application Ser. No. 08/326,901 filed, Oct. 21, 1994, U.S. Pat. No. 5,540,591 which is a continuation-in-part of prior application Ser. No. 08/145,544 filed, Nov. 4, 1993, U.S. Pat. No. 5,429,564 which in turn is a continuation-in-part prior application Ser. No. 07/998,195, now abandoned, filed Dec. 29, 1992, each of which is incorporated herein by reference.

FIELD OF THE INVENTION

The present invention relates to the field of exercising apparatus for athletic activities, and more specifically to a waterless swimming trainer. The exercising apparatus can be used to improve strength and technique.

BACKGROUND OF THE INVENTION

Exercising apparatus, to be useful, should allow the user to strengthen only those muscles necessary for a particular sport. For a swimming simulator, the rotation and body positioning during exercise should fully simulate the motions involved in swimming in water. Existing exercise devices include swim benches which permit some form of rotation of the body, however, independent rotation of the upper and lower body portions of the user is not provided by the prior art systems.

For example, U.S. Pat. No. 4,674,740 issued to Iams et al. on Jun. 23, 1987 discloses a swimming trainer which allows for a rocking motion of the body during execution of the stroke. The user's torso and hips in the Iam device lay on a common bench and the entire frame moves as one, causing the entire body to rock. A drawback to this design is that the lower body must rotate with the upper body.

Another related swimming machine uses two independent supports for the upper and lower body. In U.S. Pat. No. 5,158,513, issued to Reeves on Oct. 27, 1992, the user's body is supported in a generally horizontal position so the user can pull against hand paddles which activate a resistance mechanism. However, the support for the upper body which allows for chest rotation forces the chest out of line with the head because its center of rotation is below the body. A proper stroke technique requires that the body should rotate about a center axis which is approximately in line with the spine of the body.

In U.S. Pat. No. 5,354,251 to Sleamaker, a swimming machine that uses a bench support for the user's body is provided where the bench actually tilts from side to side. This allows for movement and rotation of the body from side to side in order for the user to lean into the stroke. However, this type of movement causes a user to weave from left and right while he/she progresses through the water. Thus, the swimmer would be traveling a greater distance because they would not be moving in a straight line.

Other exercising devices such as that of U.S. Pat. Nos. 4,830,363 and 3,791,646 are known, however, unlike the present invention, the prior art does not provide for the independent movement where the torso or upper body portion is permitted to rotate with a center of rotation that is located above the bench and approximately in line with most users' spines.

SUMMARY OF THE INVENTION

The present invention relates generally to the field of exercising apparatus for athletic activities, where the torso of a user does not actually move from side to side, but rotates about a center of rotation axis approximately in line with a user's spine. The present invention can be used as a waterless swim trainer or on exercising equipment to allow for greater mobility and proper technique when performing various exercises. When used on a waterless swim trainer, the apparatus allows the user to perform technically correct strokes with proper body positioning and strengthen only those muscles used when swimming in the water. When used on other existing exercising equipment, the two benches of the present invention allow for independent mobility of the upper and lower body so that proper form can be used to isolate the specific muscles used in that sport when moving against a resistance offered by the exercising equipment.

One aspect of the present invention is to allow the user to properly simulate the motions involved in a sport for which the exercise machine has been designed.

Another aspect of the present invention is to provide body support which permits proper body motion on a waterless swim training exercise machine, that may include a resistance system for the hands, thereby permitting natural side-to side rolling motion of the torso that the swimmer experiences when applying a stroke using alternate hands sequentially as in the freestyle stroke. This rotational motion is about a center axis approximately in line with the spine. This rotational movement of the chest must be independent of the motion, or lack thereof, of the user's lower body. The lower body rests on a padded support which can be either fixed in the horizontal position or allowed to tilt from side to side or swivel.

Another object of the invention is to cradle the upper torso or chest of a user with foam padding to assist the body of the user from rolling off the machine during the rocking motion.

Yet another object of the invention is to aid the body in returning to a horizontal position after rolling to the side to perform a stroke via springs that are attached to the two sides of the rocking chest support bench and to the exercising apparatus frame to aid in returning the bench to its rest position.

A further object of the present invention is to provide an inclined torso support where the body support has an axis of rotation located between about 4 to about 7 inches above an upper surface of the torso support and is inclined at an angle of between about 5° to about 10° from a horizontal plane.

These and other objects and salient features of the invention will become more apparent from the following detailed description and annexed drawings.

DETAILED DESCRIPTION OF THE INVENTION

In the present invention two separate and distinct padded benches are provided for supporting the user's torso and lower body during exercise. The torso support is moveable along a curve that is convex to the ground below, thus simulating the rocking, or rolling motion experienced during some exercises, and more specifically during swimming. The padded lower body support can be fixed in a horizontal position or pivot about an axis perpendicular to the horizontally disposed support. The two padded benches are supported by a sufficiently strong frame so as to form a predominantly horizontal area for the user to lay upon during exercise.

Figure 1:
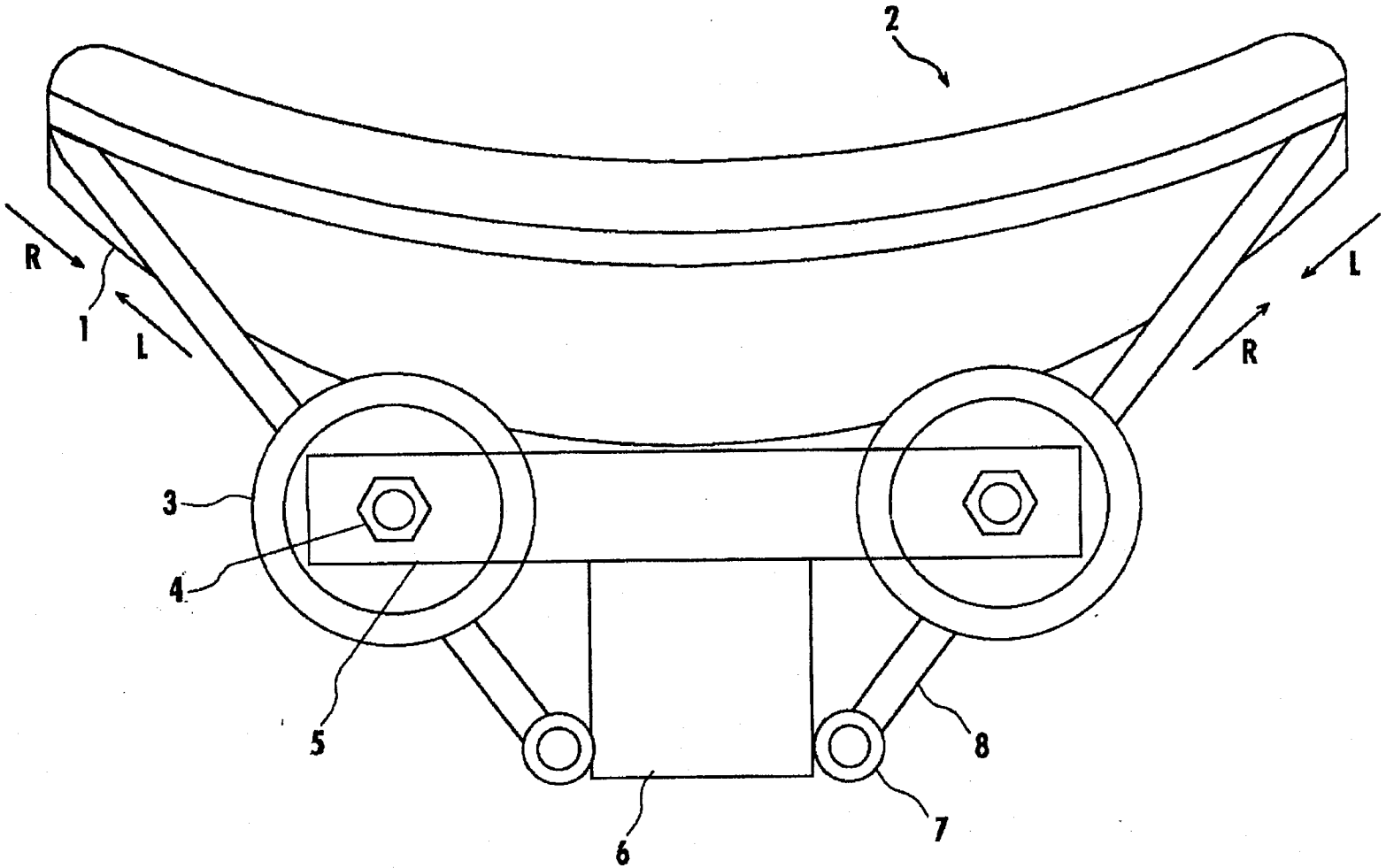
FIG. 1 is a schematic front elevation view of the front edge of the torso support and supporting undercarriage of the present invention.
Figure 2:
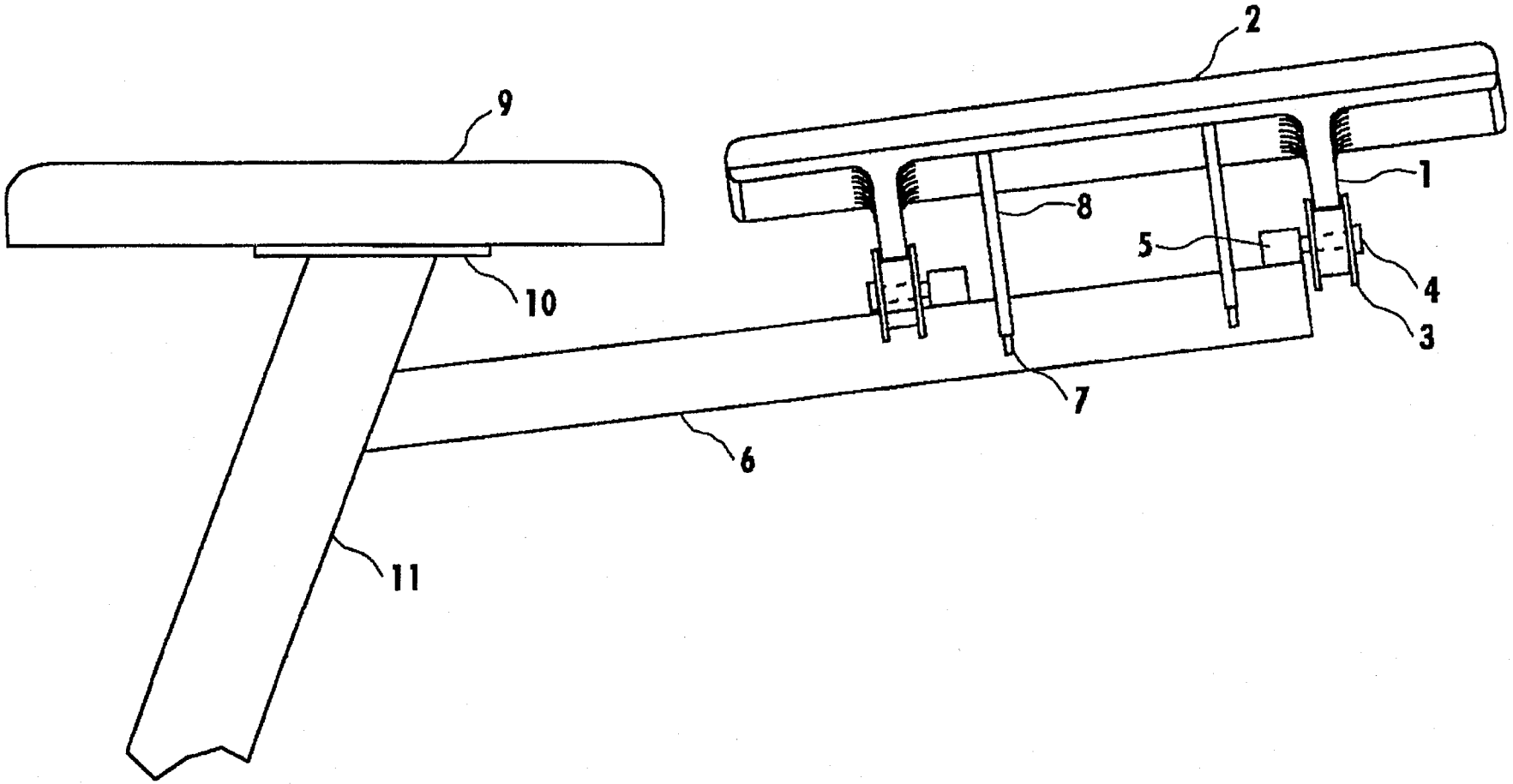
FIG. 2 is a schematic side elevation view of a preferred embodiment of the apparatus of the present invention.

The invention will now be discussed with reference to FIGS. 1 and 2. The front edge of the torso support and supporting undercarriage of the invention is shown in a front elevation view of FIG. 1. FIG. 2 is a side elevation view of the invention showing both the torso support and the lower body support along with one form of supporting undercarriage. Although an inclined cantilever is depicted, other shapes, curvelinear, horizontal can be used.

FIG. 2 shows a substantially horizontal cross-bar 6 and support bar 11 that together form a cantilevered support for the two padded benches. The support bar 6 is secured to a base (not shown) which allows the two padded benches to sit away from the ground to allow for unobstructed movement of the user's hands and arms. The body support frame comprised of the horizontal cross-bar 6 and the support bar 11 do not have to form a cantilevered support. The two padded benches need only be supported above the ground in a predominantly horizontal position to be in contemplation of the invention. A cantilevered support does offer functional advantages.

The lower body support 9, hereinafter referred to as hip support 9, is secured to a mounting plate 10 which is fixed to support bar 11. In a preferred embodiment the hip support 9 is fixed in a horizontal position and does not rotate or move. The torso support 2 is slidable from side to side along a curved track that is convex to the ground. The means by which this slidability is facilitated is discussed below, with reference to FIGS. 1 and 2.

In a preferred embodiment, the present invention comprises the body support means for a waterless swim trainer. To use the invention, for a free-style stroke, a user rests his/her hips or upper thighs on hip support 9 and torso on torso support 2. The user's arm-pits and shoulders should be even with the forward leading edge of torso support 2. As the user's hands and arms move to simulate the free-style swimming motions his/her torso alternately rocks and rolls from left to right on the torso support 2 as would occur while swimming in water. The details of the rocking torso support 2 are explained below.

The horizontal support bar 6 is supported by support bar 11 high enough above the ground such that the user's hands would not touch the ground during full extension of a stroke. When a swimmer practices strokes that feature the alternate use of one arm followed by the other, such as the free-style or backstroke (as opposed to strokes that feature the simultaneous symmetric motion of both arms, such as the breast stroke or butterfly), the swimmer's body rolls in the water, first to one side, then to the other, and then back again. This rolling motion is satisfactorily simulated by sliding the torso support 2 along a curved track, which is convex to the ground. The means by which the torso support 2 is enabled to slide along a curved track is shown schematically with further reference to FIG. 1 and FIG. 2.

The torso support 2 is preferably made from a single piece of formed plastic. There is an additional layer of foam padding secured to the top of the torso support 2. This torso support 2 must be firm and durable enough to support the user's weight over many hours of use, and also soft enough so that the user is comfortable while resting upon it. The torso support 2 is formed with a curved top surface to cradle the user's chest and keep them from falling off during the side to side rolling motions. The upper surface may be altered to conform to a user's chest. It has been found that a curved surface provides suitable comfort. From the top curved surface two curved, e.g., crescent shaped pieces 1 extend below, each has a rolling surface on its bottom that is shaped according to the desired curve of motion. The crescent support pieces 1 are shaped so that their axis of rotation runs approximately even with the user's spine. Each has a radius of curvature of about 8 inches. The curvatures may be altered for a larger radius. The axis of rotation is depicted in FIG. 1.

The crescent shaped support pieces 1 each rest upon a pair of rollers 3, which can be made of polyurethane, wood, metal, or any other suitable material. Rollers with integral ball bearings provide the smoothest rolling motion. The rollers 3 are mounted on axles 4 which in turn are fixed to roller mounts 5. The roller mounts 5 are supported by horizontal cross-bar 6. As is shown in FIG. 2, a set of rollers 3, crescent shaped pieces 1, etc., is provided at both the forward and rearward ends of torso support 2. As the user tips his/her body naturally due to the motion of one arm or the other, the body tends to roll down on the side on which the arm is moving forward and downward. Because the torso support 2 is free to slide on its crescent shaped pieces 1 along rollers 3, it does so, allowing the body to roll naturally down toward the center of the torso support 2.

For instance, if the user simulates a free-style stroke, lying on his/her chest, and casts his/her right arm forward and downward into the space that would be below the water's surface, the torso support rolls in the direction indicated by the arrows R in FIG. 1 (looking at the torso support from the user's head). For the opposite, left armed stroke, the torso support rolls in the direction indicated by the arrows L in FIG. 1. In a preferred embodiment, the axis of rotation of the torso support is approximately five inches above the upper surface of the torso support's foam padding, which is approximately the location of the user's spine. Thus, as in swimming, the user's head does not move up and down or side to side during use, only the torso rotates.

In a preferred embodiment the torso support 2 does not move rearward or forward with respect to the rollers 3 or the hip support 9. It is therefore necessary to secure the torso support downward to the rollers 3. It is also helpful to use rollers 3 which are grooved such that the crescent shaped pieces 1 sit in the roller's groove to further restrain forward and rearward movement of the torso support. In a preferred embodiment two spring mounting rings 7 are secured to the each side of the horizontal support cross-bar as shown in FIGS. 1 and 2. Two springs or resilient bands 8 are secured to the outer edges of the torso support 2 between the crescent shaped pieces 1. These springs 8 are secured at the other end to the spring mounting rings 7 located on the side of horizontal cross-bar 6. In this way the springs or resilient bands 8 serve to hold the torso support 2 down to the rollers 3.

The bench should return to a neutral position almost effortlessly. In order to assist the rolling of the body back to the neutral position between strokes, the resilient band or spring 8 discussed above stretches on one side when the body is rolled downward during the catch portion of a stroke. When the body is rolled back to the neutral position the band/spring 8 assists to pull the body back to the neutral position. The bands/springs may be rubber tubing, bungee cord, coiled springs or other elastic media.

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims.

Having described the invention, what is claimed is:

1. An exercising apparatus comprising:

a) a first support member;

b) a second body support member for a user's lower body portion mounted on said first support member; and c) a third, inclined body support member for a user's upper body portion, said third body support member being independent of said second body support member and mounted on said first support member for limited rotation about a center axis above said third body support member.

2. An exercising apparatus according to claim 1, wherein said third body support member has an axis of rotation located between about 4 to about 7 inches above an upper surface of said second body support member.

3. An exercising apparatus according to claim 1, wherein said third body support member is inclined at an angle of between about 5° to about 10°.

4. An exercising apparatus according to claim 1, wherein said third body support member has an upper surface that is substantially concave and may be altered to conform to a user's chest.

5. An exercising apparatus according to claim 1, wherein said third body support member has an upper surface and a radius of curvature that may be altered for a larger radius.

6. An exercising apparatus according to claim 1, wherein said first support member is a cantilevered member.

7. An exercising apparatus according to claim 1, wherein said first support member is a linear or curved support beam.

8. An exercising apparatus according to claim 1, wherein said second support member has an upper surface that is substantially horizontally disposed.

9. An exercising apparatus according to claim 1, wherein said second support member is movable.

10. An exercising apparatus according to claim 1, wherein said second and third support members each have an upper padded surface.

11. An exercising apparatus according to claim 1, wherein said third support member has a lower surface that is convex and rests upon a pair of parallel rollers with mounting means for attachment to said first support member.

12. An exercising apparatus comprising an upper torso support, said upper torso support having an axis of rotation located between about 4 to about 7 inches above an upper surface thereof and being inclined at an angle of between about 5° to about 10° from a horizontal plane.

13. An exercising apparatus according to claim 12, wherein said support has an upper surface that is substantially concave.

* * * * *